US010421920B1

(12) United States Patent
Stolpen et al.

(10) Patent No.: US 10,421,920 B1
(45) Date of Patent: Sep. 24, 2019

(54) BIODEGRADABLE, NON-TOXIC LUBRICANT COMPOSITION PROCESSES OF MAKING IT AND METHODS FOR ITS USE

(71) Applicant: SAFE HARBOUR PRODUCTS, INC., Norwalk, CT (US)

(72) Inventors: Adam Stolpen, Norwalk, CT (US); William Woodworth, Norwalk, CT (US)

(73) Assignee: SAFE HARBOUR PRODUCTS, INC., Norwalk, CT (US)

( * ) Notice: Subject to any disclaimer, the term of this patent is extended or adjusted under 35 U.S.C. 154(b) by 3 days.

(21) Appl. No.: 15/485,788

(22) Filed: Apr. 12, 2017

Related U.S. Application Data

(60) Provisional application No. 62/321,851, filed on Apr. 13, 2016.

(51) Int. Cl.
*C10M 101/02* (2006.01)
*C10M 127/02* (2006.01)
*C10M 127/06* (2006.01)

(52) U.S. Cl.
CPC ..... *C10M 101/02* (2013.01); *C10M 127/02* (2013.01); *C10M 127/06* (2013.01); *C10M 2203/003* (2013.01); *C10M 2203/022* (2013.01); *C10M 2203/06* (2013.01); *C10N 2230/64* (2013.01)

(58) Field of Classification Search
CPC ..... C10M 101/02; C10M 127/06; C10M 127/02; C10M 2203/003; C10M 2203/022; C10M 2203/06; C10N 2230/64
See application file for complete search history.

(56) References Cited

U.S. PATENT DOCUMENTS 4,427,564 A * 1/1984 Brownawell ..... C09K 8/02 166/301
5,154,840 A * 10/1992 Drake ..... C10M 169/00 508/122
5,348,668 A * 9/1994 Oldiges ..... C10M 111/04 106/287.18
7,553,801 B2 * 6/2009 Alexander ..... B01J 13/0065 208/16
7,589,049 B2 * 9/2009 Bradbury ..... B02C 23/06 507/224
8,236,167 B2 * 8/2012 Lacerenza ..... C10M 101/02 208/19
9,068,134 B2 * 6/2015 Deckman ..... C10M 105/32
2002/0006519 A1 * 1/2002 Anglin ..... C10M 101/00 428/457
2003/0008783 A1 * 1/2003 Ostyn ..... C10M 169/04 508/272
2004/0018947 A1 * 1/2004 Anglin ..... C10M 101/00 508/428
2005/0288195 A1 * 12/2005 Heenan ..... C10M 129/76 508/430
2011/0114537 A1 * 5/2011 Lacerenza ..... C10M 101/02 208/19
2014/0357825 A1 * 12/2014 Volker ..... C10M 143/06 526/348

FOREIGN PATENT DOCUMENTS

EP 1123962 A1 * 8/2001 ..... C10M 101/02

* cited by examiner

*Primary Examiner* — Pamela H Weiss
(74) *Attorney, Agent, or Firm* — Abelman, Frayne & Schwab

(57) ABSTRACT

A biodegradable, non-toxic lubricant is described. Also described are methods of using the composition, and processes of making it.

11 Claims, No Drawings

BIODEGRADABLE, NON-TOXIC LUBRICANT COMPOSITION PROCESSES OF MAKING IT AND METHODS FOR ITS USE

RELATED APPLICATIONS

This application claims priority from U.S. Provisional patent application Ser. No. 62/321,851 filed Apr. 13, 2016, and incorporated by reference in its entirety.

BACKGROUND OF THE INVENTION

1. Field of the Invention

The invention relates to a biodegradable lubricant composition, methods for using this composition, and processes for making it.

2. Background and Prior Art

Lubricating compositions are useful in many contexts. The ubiquity of "WD-40," a proprietary formulation, is evidence of this. WD-40 and other lubricants are useful in the context of, e.g., automotive and mechanical applications, marine and recreational uses, industrial and commercial applications, as well as home uses. Prior to the present invention, lubricants which are useful in all contexts have not been seen. For example, while the ubiquity of WD-40 has been mentioned, it is unsafe for consumption, and thus cannot be used in the kitchen in the way other "cooking sprays" and other materials are.

Indeed, this failing point to a shortcoming in the lubricants of the prior art. In short, they are not biodegradable, and many are toxic. The invention which is described in the disclosure which follows provides for a biodegradable, non-toxic lubricant composition which has a multiplicity of uses including but not being limited to those described supra.

SUMMARY OF THE INVENTION

The invention is a biodegradable, non-toxic lubricant composition which comprises various hydrocarbon components.

DETAILED DESCRIPTION OF PREFERRED EMBODIMENTS

The compositions of the invention comprise biodegradable hydrocarbons. More specifically, they comprise white mineral oil such as "Duoprene 350," a mixture of alkylated naphthalenes, such as "Synesstic AN," a mixture of isoparaffins, such as "Isopar M," a mixture of dearomatized hydrocarbon fluids, such as "Exxsol 95," and, an appropriate solvent for the foregoing materials, such as the hydrotreated middle distillate, "Conosol 260." See, e.g., U.S. Pat. Nos. 7,820,187; 9,220,053; 9,149,772; 9,138,409; and 9,012,515, all of which are incorporated by reference, for further information on the preferred embodiments of the composition. Preferably, the compositions of the invention contain from about 25-45 weight percent of white mineral oil, more preferably 30-45 weight percent, and more preferably 40-45 weight percent. (All reference to "percent" made herein refer to weight percent relative to the composition.) Further, the composition comprises from about 1 to about 10, more preferably from about 3 to about 10, and more preferably from about 3 to about 5 weight percent alkylated naphthalenes. The composition further comprises from about 1 to about 5, more preferably from about 1 to about 3, and more preferably from about 1 to about 2 weight percent of each of the dearomatized hydrocarbon fluid and isoparaffins. The composition also comprises from about 20 to about 70, more preferably from about 40 to about 60, and most preferably from about 50 to about 60 weight percent of a hydrotreated middle distillate.

A preferred embodiment of the composition contains the following components, given in weight percent:

| | |
|---|---|
| Duopreme 350: | 40.5 |
| Synesstic AN | 4.5 |
| Isopar M: | 1.5 |
| Exxsol D95: | 1.5 |
| Conosol 260 | 52.0 |

Additional materials may be added, such as an aerosolizing agent, (e.g., a propellant), perfuming or other inactive ingredients, biodegradable dyes, and so forth, which will be clear to the skilled artisan.

Other embodiments of the invention will be clear to the skilled artisan and will not be elaborated herein.

The terms and expression which have been employed are used as terms of description and not of limitation, and there is no intention in the use of such terms and expression of excluding any equivalents of the features shown and described or portions thereof, it being recognized that various modifications are possible within the scope of the invention.

The invention claimed is:

1. A non-toxic biodegradeable lubricant composition comprising:

(a) from about 25 to about 45 weight percent white mineral oil;

(b) from about 1 to about 10 weight percent alkylated naphthalenes;

(c) from about 1 to about 5 weight percent dearomatized hydrocarbon fluids;

(d) from about 1 to about 5 weight percent isoparaffins, and;

(e) from about 40 to about 60 weight percent of a hydro-treated middle distillate, wherein each of (a)-(e) constitutes a separate component of said lubricant composition.

2. The lubricant composition of claim 1, comprising from about 30 to about 45 weight percent white mineral oil.

3. The lubricant composition of claim 1, comprising from about 40 to about 45 weight percent white mineral oil.

4. The lubricant composition of claim 1, comprising from about 3 to about 10 weight percent alkylated naphthalenes.

5. The lubricant composition of claim 1, comprising from about 3 to about 5 weight percent alkylated naphthalenes.

6. The lubricant composition of claim 1, comprising from about 1 to about 3 weight percent dearomatized hydrocarbon fluid.

7. The lubricant composition of claim 1, comprising from about 1 to about 2 weight percent dearomatized hydrocarbon fluid.

8. The lubricant composition of claim 1, comprising from about 1 to about 3 weight percent isoparaffins.

9. The lubricant composition of claim 1, comprising from about 1 to about 2 weight percent isoparaffins.

10. The lubricant composition of claim 1, comprising from about 50 to about 60 weight percent hydrotreated middle distillate.

11. The lubricant composition of claim 1, consisting of:

(a) 40.5 weight percent white mineral oil;

(b) 4.5 weight percent alkylated naphthalenes;

(c) 1.5 weight percent isoparaffins;

(d) 1.5 weight percent dearomatized hydrocargbon fluids; and (e) 52.0 weight percent hydrotreated middle distillates.

* * * * *